United States Patent [19]

Logan

[11] 4,271,691

[45] Jun. 9, 1981

[54] EMERGENCY RELEASE FOR DEADLOCKS

[75] Inventor: Emanuel L. Logan, Silver Spring, Md.

[73] Assignee: Reliable Security Systems, Inc., Columbus, Ohio

[21] Appl. No.: 93,446

[22] Filed: Nov. 13, 1979

[51] Int. Cl.[3] ..... E05B 63/00; E05C 13/00

[52] U.S. Cl. ..... 70/422; 292/254; 70/DIG. 49

[58] Field of Search ..... 70/422, 92, DIG. 49; 292/254, 92, 341.15, 255

[56] References Cited

U.S. PATENT DOCUMENTS

| | | | |
|---|---|---|---|
| 528,108 | 10/1894 | Paul | 292/254 |
| 1,888,967 | 11/1932 | Constable | 292/254 |
| 2,931,207 | 4/1960 | Fisher | 70/422 |

FOREIGN PATENT DOCUMENTS

| | | | |
|---|---|---|---|
| 12903 | of 1914 | United Kingdom | 292/254 |

*Primary Examiner*—Robert L. Wolfe

*Attorney, Agent, or Firm*—Quaintance, Murphy & Richardson

[57] ABSTRACT

An emergency release for key operated deadlocks includes a ram rod for forcing a deadbolt out of a keeper so as to allow a deadlocked door to open under emergency conditions. The release further includes a yieldable element disposed between the key operator for the deadbolt, which yieldable element deforms as the deadbolt is forced back by the ram. An alarm is activated upon operation of the emergency release to discourage intruders from trying to open the door with the emergency release. Preferably, the rod is advanced by a rack-and-pinion arrangement which is operated by a wire coiled around a spool.

10 Claims, 4 Drawing Figures

EMERGENCY RELEASE FOR DEADLOCKS

BACKGROUND OF THE INVENTION

The instant invention relates to deadlocks, and more particularly the instant invention relates to deadlocks with a provision for emergency release.

PROBLEM AND PRIOR ART

Increasing crime has raised the security consciousness of many people resulting in literally millions of residences and buildings being secured by key operated deadlocks which must be opened from both outside and inside a building with a key. In emergency situations, such as fires, when rapid egress from a home or business is essential, the proper key may not be readily accessible. Consequently, hundreds of lives have been lost simply because the proper key was not readily accessible to unlock a deadbolt locked door. Frequently, the key is in another room or is left on a key ring in another part of the house, for example, upstairs in a bedroom. The fire can be between the person or people trying to escape and the building can be filled with smoke obscuring vision and adding to the general panic.

The prior art offers no solution to these problems other than not using key operated deadlocks. However, the advantages of key operated deadlocks and detering crime are great in that these locks prevent a prospective intruder from simply breaking the glass or panel in an outside door and gaining entry to a building by reaching in and opening the door from the inside. The locks also make it difficult to open a door from the inside so as to carry property out through a door. In essence, upon weighing the risk, people are not going to give up the security of key-operated deadlocks for fire safety reasons. Accordingly, there is a need for a deadlock which functions as the usual deadlock under ordinary circumstances but allows one to rapidly open a deadlocked door when there is an emergency.

SUMMARY OF THE INVENTION

In view of the aforementioned considerations, it is a feature of the instant invention to provide an emergency operating means for a key-operated deadlock allowing one to immediately open a lock during an emergency situation.

In view of this feature, and other features, the instant invention contemplates an emergency release device for a deadlock wherein the lock includes a dead bolt mounted in a first member for securring the first member to a second member by spaning a gap therebetween and seating in a keeper on the second member. The emergency release device includes a yieldable connector in the deadlock between a key operator and the deadbolt which yields upon forcing the deadbolt back into the lock. The deadbolt is forced back into the lock by an emergency operating means disposed in the keeper.

The instant invention further includes an alarm which sounds only when the deadbolt is moved by the emergency operating device.

DESCRIPTION OF THE PREFERRED EMBODIMENT

Figure 1:
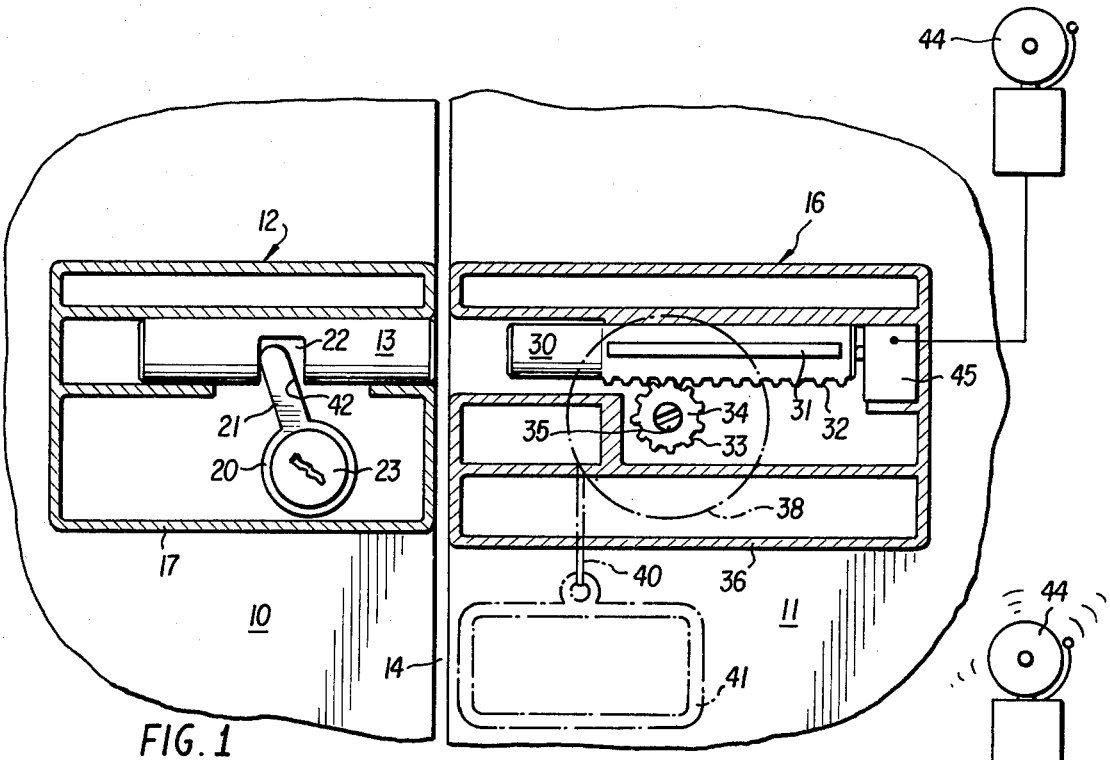
FIG. 1 is a side elevation of the deadlock and emergency release device of the instant invention showing the lock open.
Figure 3:
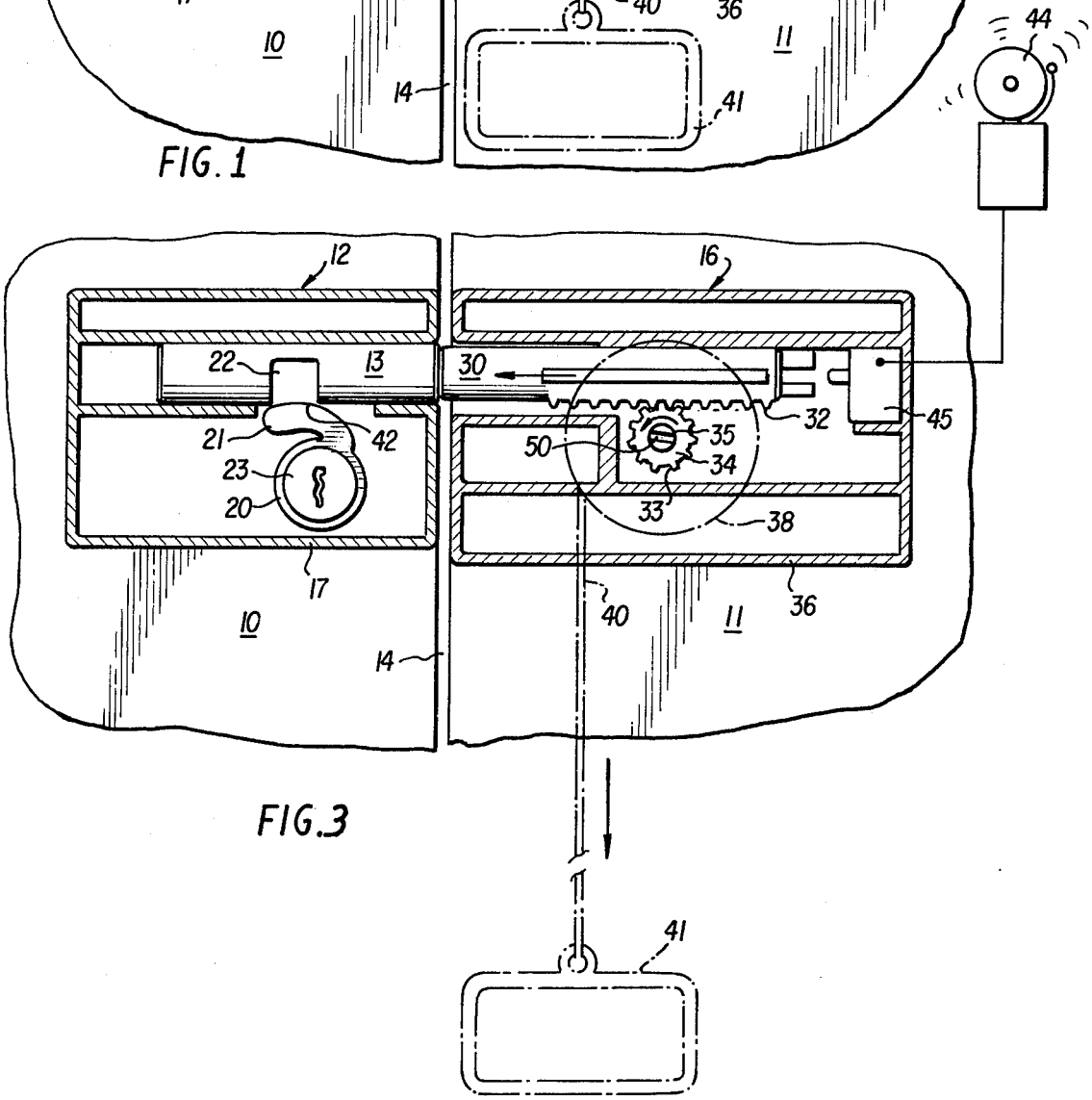
FIG. 3 is a view similar to FIGS. 1 and 2 showing the emergency device operating.
Figure 2:
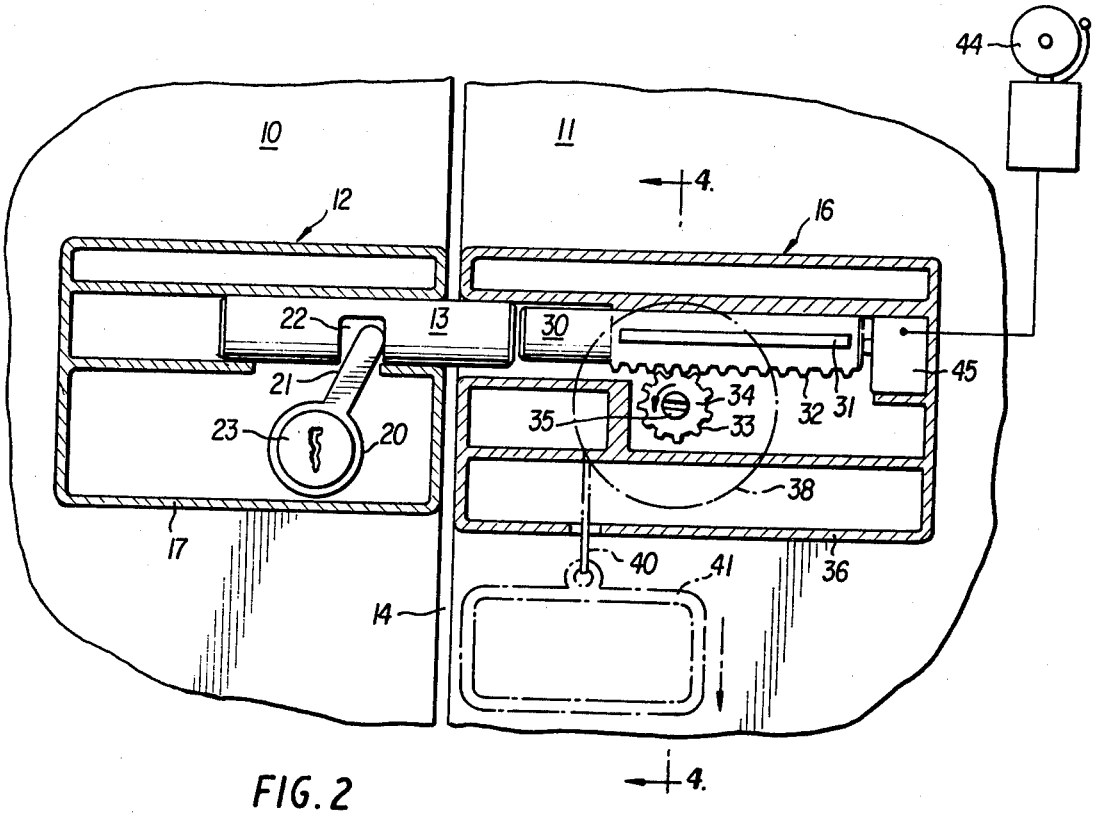
FIG. 2 is a view similar to FIG. 1 showing the deadlock with its deadbolt projected to lock a door.
Figure 4:
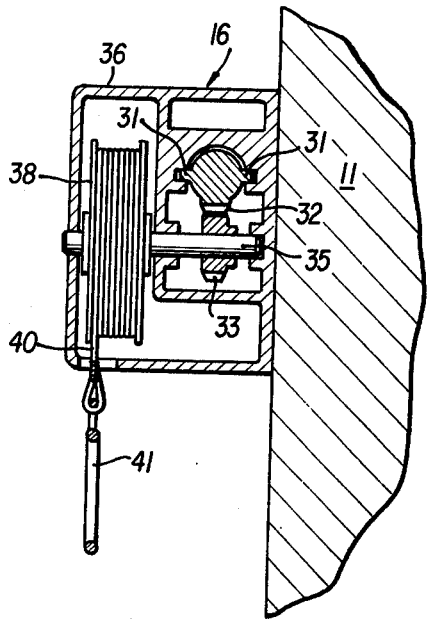
FIG. 4 is an elevation taken along line 4—4 of FIG. 1.

A door 10 is secured to a door frame 11 by a deadlock, designated generally by the numeral 12. The deadlock 12 is a key-operated lock which must be opened by a key from both inside and outside of the door 10. The lock is shown schematically and accomplishes its locking function by projecting a dead-bolt 13 across the gap 14 between the door 10 and frame 11 and into a keeper 16. The deadbolt 13 includes no camming surfaces thereon so that it cannot be cammed back into the casing 17.

In accordance with the principals of the instant invention, the deadbolt 13 is projected by an operating member or cam 20 having a projection 21 extending therefrom which is received in a slot 22 in the bolt. As the operating member 20 is rotated in the clockwise direction by a key lock 23, the projection 21 urges the deadbolt 13 to move to the right and project from the lock housing 16, across the gap 14 and into keeper 16. In accordance with the instant invention, the projection 21 is made of a yieldable material which deforms under stress. Alternatively, the projection 21 may be made of a frangible material which yields by breaking when stress is applied to the bolt 13. In any event, the bolt 13 is able to overcome the projection 21 by causing the projection to yield so that the bolt slides back into the lock housing 16 to allow the door 10 to open by swinging relative to the door frame 11.

Since the deadbolt 13 has no camming surface which would enable one to apply axial pressure to the bolt so as to move the bolt to the left and thereby retract the bolt, the projection 21 need not be very strong. It is only necessary that the bolt 13 resist laterial forces tending to swing the door 10 relative to the door frame 11. Accordingly, the projection 21 on the operating member 20 can be relatively weak so that the projection may be overcome by a relatively small force, such as that applied by a child.

In accordance with the instant invention, the deadbolt 13 is forced back into housing 12 by moving a ramming rod 30 in the keeper 16 to the left in order to engage the free end of the bolt and push the bolt to the left and back across the gap 14. The rod 30 is mounted in keeper 16 in coaxial relation with the deadbolt 13 and is restrained for sliding movement therein by ribs 31. In order to move the ram 30 to the left, the ram has a series of teeth 32 thereon which form a rack which is engaged by teeth 33 of a pinion 34 which is mounted on a spindle 35 journaled in the housing 36 of keeper 16. In order to conveniently rotate the pinion 34 in the counter-clockwise direction so as to advance the ram rod 30, a spool 38 is keyed to spindle 35. Around the spindle 38 is wound a strand 40 of wire or other strong material to which is attached a loop 41 which is finger-engaged. As the loop 41 is pulled, the spool 38 rotates thereby rotating the spindle 35 and the pinion 34. This forces the deadbolt 13 back into the housing 17 of the deadlatch and overcomes the resistance of projection 21 causing the projection to yield. Preferably, the projection 21 is simply deformable so that upon rotating the key mechanism 20 to again project the bolt 13, the projection 21 will reengage slot 22 so that the bolt can thereafter be projected and retracted upon rotating the key mechanism 23. A notch 42 is provided to accomplish this. Accordingly, people can practice operating the emergency mechanism so that they will be familiar with it should a fire occur. Moreover, it allows the system to be tested after installation and to be tested periodically.

In order to defeat attempts by an intruder to open the door by simply breaking a window or panel and pulling the ring 41, the device is equipped with an alarm 44 which is set off by a micro-switch 45 positioned at the rear end of the ram rod 30. When the finger 41 is pulled, moving the ram rod 30 to the left, micro-switch 45 is closed, thereby operating the alarm 44 indicating that the emergency operator is being tampered with. This both frightens off intruders and notifies people that a break-in is being attempted. In order to prevent an intruder from quickly opening the door and shutting off the alarm, the spindle 38 is contained within the keeper housing 36, and must be rotated to rewind the strand 40 by a screwdriver inserted into a slot 50 in the spindle to rewind the strand 40. Alternatively, the spindle can be mounted on the shaft 35 with a one-way clutch which allows rotation only in the counter-clockwise direction to advance the ram rod 30 by pulling the strand 40. The clutch must be key-operated with the key for mechanism 23 in order to be rotated in the other direction to rewind the strand 40 so as to stop the sounding of alarm 44.

If electricity is not conveniently available at the door, the alarm 44 may use a conventional battery for its operation and is contained in a secure housing which can be opened only by unscrewing a number of screws or by a key in order to change the battery or to shut the alarm off.

From the foregoing discussion, it is apparent that the alarm and its relationship with the ram rod 30 will rather drastically discourage intruders while the emergency condition operating device allows quick egress from a room or building in the event of a fire or other emergency. Accordingly, the invention provides a structure for providing the security of a keyoperated dead lock without sacrificing the safety of building occupants.

What is claimed is:

1. An emergency release device for a deadbolt wherein the deadbolt is mounted on a first member and secures the first member to a second member by spanning a gap therebetween and seating in a keeper in the second member, the device comprising;

a key lock;

a yieldable means connecting the key lock to the bolt for projecting and retracting the deadbolt upon turning a key in the key lock;

emergency operating means for moving the deadbolt from the keeper by overcoming the resistance of the yieldable means whereby, in an emergency situation, the first member can be unlocked from the second member to move with respect to the second member.

2. The device of claim 1 wherein the members are a door and door frame.

3. The device of claim 2 further including alarm means for sounding when the deadbolt is moved by the emergency operating means.

4. The device of claim 3 wherein the deadbolt is mounted on the door and the keeper and alarm means are mounted on the door frame.

5. The device of claim 4 wherein the emergency operating means is positioned in the keeper and engages the free end of the deadbolt to push the deadbolt out of the keeper.

6. The device of claim 5 wherein the emergency operating means includes a rod for engaging the free end of the bolt, a rack on the rod and a pinion meshed with the rack whereupon rotation of the pinion urges the rod against the bolt and the bolt back out of the keeper.

7. The device of claim 6 wherein the pinion includes a spool connected thereto around which is coiled a strand which when pulled, rotates the pinion to advance the rod and move the bolt.

8. The device of claim 7 wherein the keeper includes housing means for enclosing the rod and the spool and wherein an operator for pulling the strand is outside of the housing.

9. The device of claim 8 wherein the operator is a ring.

10. The device of claim 8 or 9 further including means for frustrating rapid rewinding of the strand and retraction of the rod whereby an unauthorized person can not rapidly shut off the alarm means.

* * * * *